US008379893B2

(12) United States Patent
Klemenz et al.

(10) Patent No.: US 8,379,893 B2
(45) Date of Patent: Feb. 19, 2013

(54) SYSTEMS AND METHODS FOR CUSTOMIZING A HEARING AID CASING

(75) Inventors: Harald Klemenz, Singapore (SG); Daniel Reisse, Erlangen (DE); Markus Wild, Unterdietfurt (DE)

(73) Assignee: Siemens Medical Instruments Pte. Ltd., Singapore (SG)

( * ) Notice: Subject to any disclaimer, the term of this patent is extended or adjusted under 35 U.S.C. 154(b) by 1076 days.

(21) Appl. No.: 12/126,582

(22) Filed: May 23, 2008

(65) Prior Publication Data

US 2009/0290733 A1 Nov. 26, 2009

(51) Int. Cl.
*H04R 25/00* (2006.01)

(52) U.S. Cl. ..... 381/312; 705/408; 101/372

(58) Field of Classification Search ..... 381/312; 705/408; 101/372

See application file for complete search history.

(56) References Cited

U.S. PATENT DOCUMENTS

| | | | | |
|---|---|---|---|---|
| 6,144,750 | A * | 11/2000 | Levin | 381/328 |
| 2002/0122206 | A1* | 9/2002 | Currans et al. | 358/1.18 |
| 2009/0031003 | A1* | 1/2009 | Velarde | 709/217 |
| 2009/0237704 | A1* | 9/2009 | Minowa | 358/1.14 |

FOREIGN PATENT DOCUMENTS

JP 2008030347 A * 2/2008

* cited by examiner

*Primary Examiner* — Kenneth Parker
*Assistant Examiner* — Dale E Page
(74) *Attorney, Agent, or Firm* — Lempia Summerfield Katz LLC

(57) ABSTRACT

Systems and methods are provided for customizing a hearing aid casing. A user accesses a software program that allows him or her to select a type of a hearing aid. The software program further allows the user to select a motif to be displayed on at least a portion of the hearing aid casing. The software program may automatically size the selected motif based on the type of the hearing aid selected, and the selected motif may be printed on a film. The film then is coupled to the hearing aid casing to display the motif on one or more surfaces of the hearing aid casing.

8 Claims, 5 Drawing Sheets

SYSTEMS AND METHODS FOR CUSTOMIZING A HEARING AID CASING

BACKGROUND

The present embodiments relate to systems and methods for providing a customized hearing aid casing.

There are various types of hearing aids currently on the market. For example, hearing aids may be disposed substantially within a user's ear canal. These "in-the-canal" hearing aids may be molded to fit inside of the ear canal and may improve mild to moderate hearing loss. While such hearing aids are advantageous because of their small, inconspicuous size, they generally do not have space for components, such as volume controls and directional microphones. Further, they may be more expensive due to their size and may have a shorter lifespan since the batteries are generally smaller.

Other hearing aids may be disposed substantially within the external ear, resting primarily outside of the entrance to the ear canal. Hearing aids that are positioned within the external ear may be larger than those disposed within the ear canal itself, thereby permitting additional features and an extended battery life, but making them slightly more noticeable.

Another type of hearing aid is a "behind-the-ear" hearing aid, which may include a component that rests behind a user's ear. This component, which typically comprises an outer casing, may conduct sounds to an ear mold that fits inside a user's ear canal or within the outer ear. The "behind-the-ear" hearing aids have several advantages, as the outer casing may house components that may achieve improved sound acquisition, amplification and transmission, as well as improved battery life. "Behind-the-ear" hearing aids further may permit multiple external controls, such as volume and muting buttons, which may be relatively easy to access. However, since the casing rests behind a user's ear, it may be more visible than those that are disposed substantially within a user's ear canal or in the outer ear region.

The casings of behind-the-ear hearing aids typically comprise a manufacturer provided uniform color. The user therefore obtains a hearing aid and wears the color and style provided by the manufacturer in a manner that may be at least partially visible behind the ear.

BRIEF SUMMARY

By way of introduction, the preferred embodiments described below include systems and methods for providing a customized hearing aid casing. A user may access a software program that allows him or her to select a type of a hearing aid. The software program further allows the user to select a motif to be displayed on at least a portion of a casing of the hearing aid. By providing the user with software for selecting a desired motif, along with information pertaining to one or more hearing aid models, a user may customize his or her hearing aid casing using a personal computer in a relatively fast and cost-effective manner.

In a first aspect, a method is disclosed for customized a hearing aid casing. The method comprises allowing a user access to a software program. The user then may select a type of hearing aid having a casing. The user may select, using the software program, a motif to be displayed on at least a portion of the hearing aid casing. The software program may automatically size the selected motif based on the type of the hearing aid selected, for example, based on dimensions of a surface of the casing. The selected motif then may be printed on a film. The film then may be coupled to the casing, thereby displaying the motif on the selected surface of the hearing aid casing.

In a second aspect, a software program is provided that may facilitate customization of a hearing aid casing. In one embodiment, the software program is operative to automatically resize the selected motif based on the type of the hearing aid selected. Further, the user may select a motif that is pre-loaded into the software program, or a personal motif that is uploaded for use with the software program. The software program also may allow a user to edit characteristics associated with a selected motif, such as whether the selected motif will be displayed on the surface of the hearing aid casing in a landscape or portrait format, and may automatically size the selected motif to be displayed accordingly.

The present invention is defined by the following claims, and nothing in this section should be taken as a limitation on those claims. Further aspects and advantages of the invention are discussed below in conjunction with the preferred embodiments and may be later claimed independently or in combination.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like referenced numerals designate corresponding parts throughout the different views.

DETAILED DESCRIPTION OF THE DRAWINGS AND PRESENTLY PREFERRED EMBODIMENTS

Figure 1:
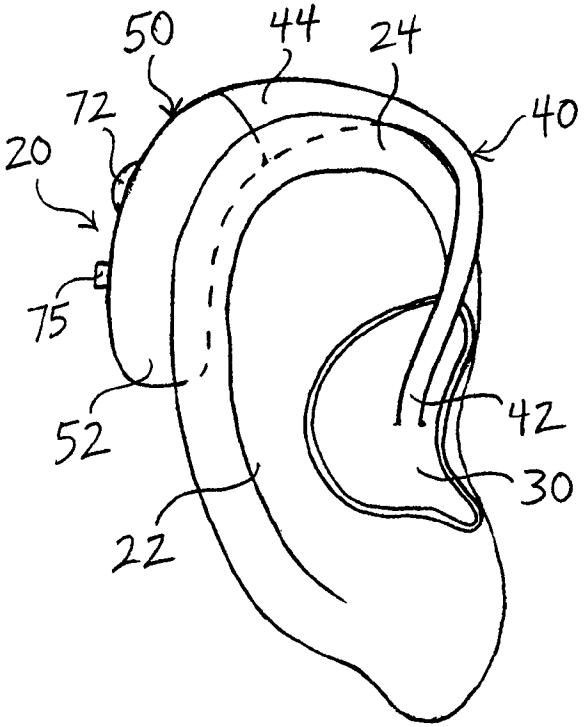
FIG. 1 is a side view of a behind-the-ear hearing aid.

The present embodiments relate generally to systems and methods for customizing a hearing aid casing. Referring now to FIG. 1, a hearing aid 20 is shown. The hearing aid 20, which has a "behind-the-ear" design, generally comprises an ear mold 30, one or more segments of tubing 40 and a casing 50. Other hearing aid designs may be used.

The ear mold 30 may comprise any suitable shape designed to transmit sound into a user's ear canal. In the embodiment shown, the ear mold 30 is designed to be substantially flush with a portion of a user's external ear 22. However, the ear mold 30 may be dimensioned to be smaller, such that it may be placed substantially or entirely within a user's ear canal, thereby making it less visible.

Figure 2:
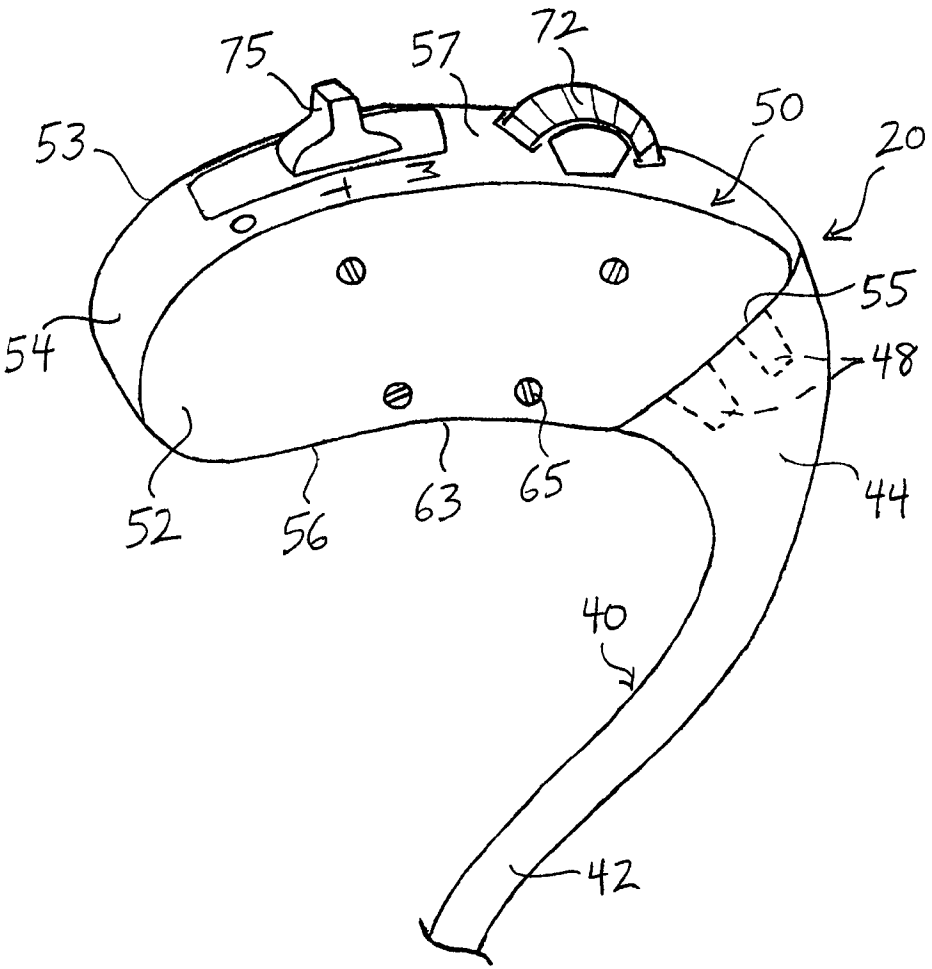
FIG. 2 is a perspective view illustrating additional features of the behind-the-ear hearing aid of FIG. 1.

The tubing 40 is coupled to the ear mold 30 in a manner that permits acoustic conduction from the casing 50 to the ear mold 30. The tubing 40 may comprise a first region 42, which may be coupled to the ear mold 30, and further may comprise an enlarged second region 44, which may be coupled to the casing 50, as shown in FIGS. 1-2. The enlarged second region 44 may be sized to be substantially flush with an outer surface of the casing 50, and may engage one or more protrusions 48 to removably secure the tubing 40 to the casing 50, as shown in FIG. 2. The tubing 40 may be curved or otherwise designed to form a hook member suitable for engaging a user's upper auricle 24, thereby allowing the hearing aid 20 to rest securely about the user's ear, as shown in FIG. 1.

The casing 50 may house multiple components. Solely by way of example, a processor, battery, microphone, amplifier, and speaker may be disposed within the casing 50. The battery provides power to the electronic parts, the microphone picks up sound, the amplifier increases the volume of the sound, and the speaker sends the sound into a user's ear. In effect, these components work together to facilitate the transmission of sound from the environment into a user's ear canal.

The casing 50 also may comprise one or more external controls. For example, a volume control 72, such as a thumbwheel, is shown in FIGS. 1-2. Further, a program button 75 may be disposed external to the casing 50. The program button 75 may comprise a slidable button having any number of settings. By way of example, three settings may be provided, where an "M" setting may be used for normal microphone use, a "T" setting may be adapted for telephone use, and an "O" setting may be used to turn the hearing aid off. The processor interfaces with the various components disposed within the casing 50, recognizes when user inputs are provided, and takes responsive actions.

The casing 50 may comprise any suitable shape. For purposes of illustrating the present embodiments, the casing 50 of FIGS. 1-2 comprises a front surface 52, a rear surface 53, a first end 54, a second end 55, a lower surface 56 and an upper surface 57. The lower surface 56, which is adapted to be positioned in close proximity to a user's ear, may comprise a concave curvature 63 to enhance comfort and/or coupling of the hearing aid 20 around the ear. Further, the volume control 72 and the program button 75 may be disposed in the upper surface 57 of the hearing aid casing 50, as shown in FIG. 2. As will be apparent, other casing shapes may be employed, and greater or fewer external controls may be provided in the same or different positions.

Figure 4:
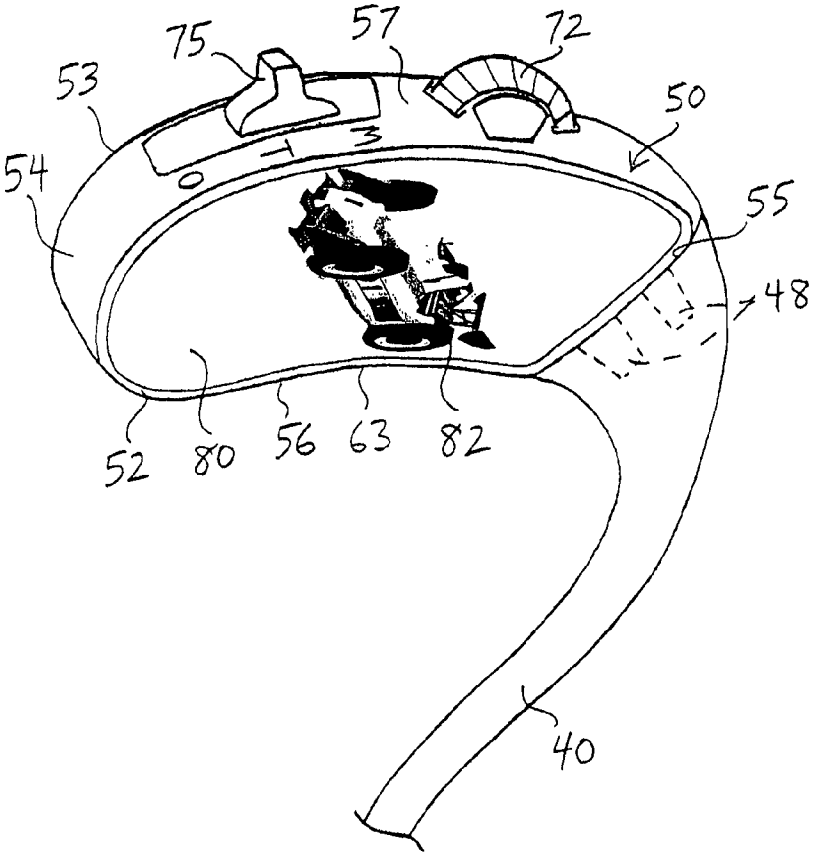
FIG. 4 is a perspective view illustrating an alternative customized hearing aid casing.
Figure 3:
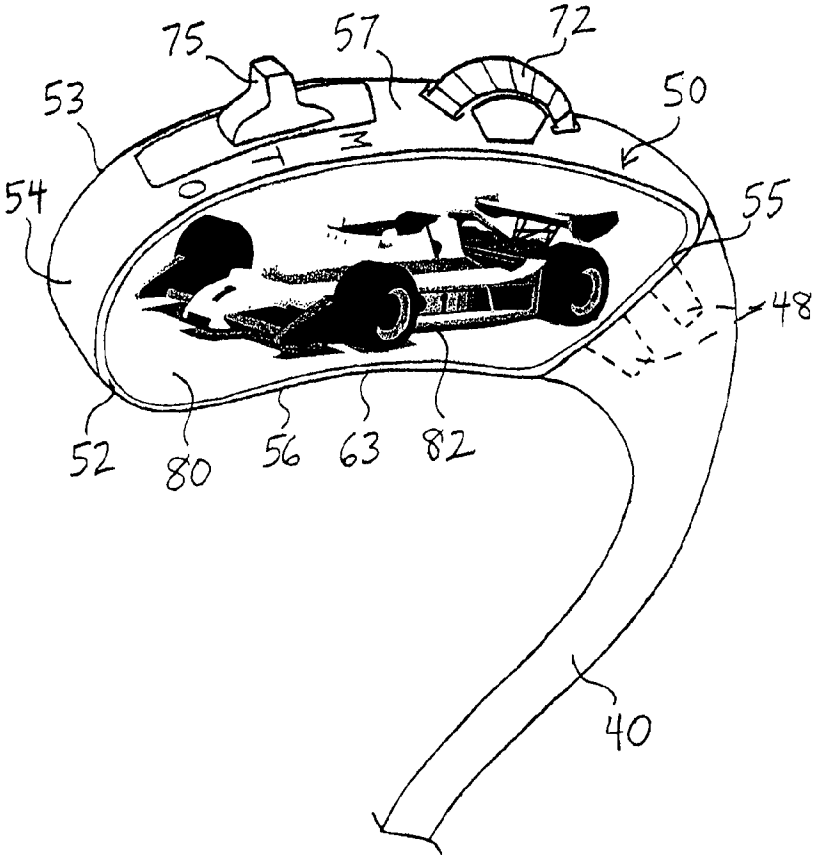
FIG. 3 is a perspective view illustrating a customized hearing aid casing.

Referring now to FIGS. 3-4, in accordance with one aspect, a user may customize the appearance of the casing 50. For example, a user may employ the techniques described below to create and apply a motif to partially or fully cover one or more of the surfaces of the casing 50.

In the embodiment of FIG. 3, a motif 82 comprising a race car design has been selected by a user to thereby customize the appearance of the hearing aid casing 50. However, a user may select numerous other motifs, including but not limited to an array of colors, patterns, sports team logos, college logos, seasonal designs, customized digital logos, or the like. The motif 82 may be selected and otherwise customized by a user using the techniques explained below with respect to FIGS. 7-8.

The motif 82 may be printed on the film 80, which then may be coupled to the hearing aid casing 50. The film 80 may comprise any suitable material, such as a thin flexible sheet of plastic, and further may be transparent or opaque.

The film 80 may be coupled to the hearing aid casing 50 using an adhesive, such as a glue. In one embodiment, the film 80 has an adhesive backing with a removable protective film. The adhesive backing is exposed by removing the protective film. Alternatively, the film 80 may be secured to the casing 50 mechanically, for example, using a clip or hook, or may be magnetically fastened to the casing 50.

The film 80 may be sized to cover a portion of any surface of the hearing aid casing 50. More specifically, the film 80 may cover one or more of the front surface 52, the rear surface 53, the first end 54, the second end 55, the lower surface 56 and the upper surface 57. When the film 80 is coupled to the hearing aid casing 50, it may cover one or more of the casing fasteners 65, which may improve the aesthetic appearance of the hearing aid casing 50.

In the embodiment show in FIG. 3, the film 80 covers a substantial portion of the front surface 52. Further, the motif 82 covers a substantial portion of the film 80. However, as will be explained further in FIGS. 7-8 below, a user may tailor the dimensions of the film 80 and/or the motif 82 with the assistance of a computer software program. The tailoring may be based, in part, on dimensions associated with a particular manufacturer and model of the behind-the-ear hearing aid 20.

Additionally, as explained further below, the software allows the user various editing and formatting options. In one example explained below, a user may display the motif 82 in a landscape format, as shown in FIG. 3, or a portrait format, as shown in FIG. 4.

If it is desired to cover multiple surfaces of the hearing aid casing 50, such as the front surface 52 and the rear surface 53, then one or more films 80 may be provided. For example, two separate films 80 may be used, such that one is dimensioned to cover at least a portion of the front surface 52 while the other is dimensioned to cover at least a portion of the rear surface 53. Alternatively, a single film 80 may be employed to cover both the front and rear surfaces 52 and 53. In the latter embodiment, the film 80 may extend at least partially over one or more of the first end 54, the second end 55, the lower surface 56 and the upper surface 57. Preferably, the film 80 does not cover user-operated buttons, such as the volume control 72 or the program button 75, so as to facilitate user access to these buttons. Alternatively, the film 80 includes holes or cut-outs to go around, under, or over user-operated buttons Referring now to FIGS. 5-6, a coupling member 100 may be used to customize the hearing aid casing 50. The coupling member 100 may be fitted over a portion of the hearing aid casing 50, and may comprise one or more elastic portions that are adapted to be secured to the hearing aid casing 50.

Figure 6:
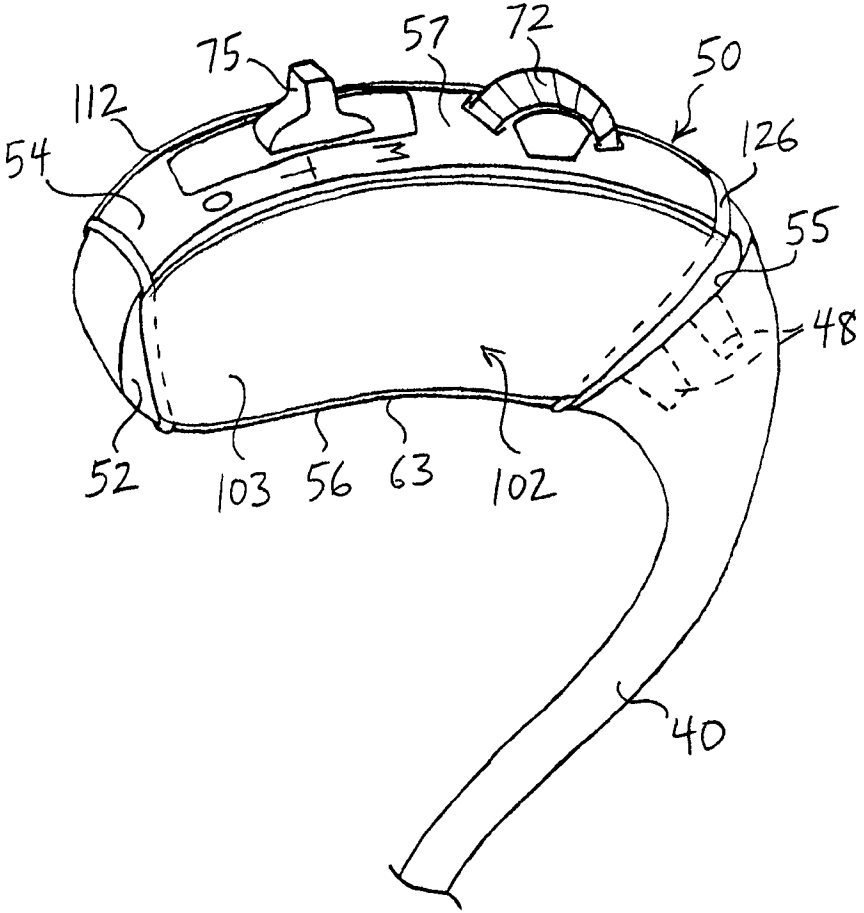
FIG. 6 is a perspective view illustrating the coupling member of FIG. 5 being coupled to the hearing aid casing.
Figure 5:
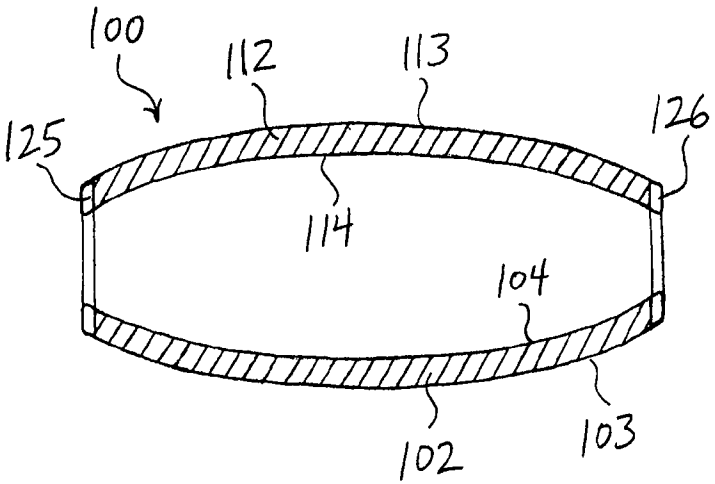
FIG. 5 is a top view illustrating a coupling member that may be coupled to a hearing aid casing.

As shown in FIG. 5, an exemplary coupling member 100 may comprise a first band 125 and a second band 126, which are adapted to secure a first member 102 and a second member 112 to the hearing aid casing as shown in FIG. 6. The first member 102 has outer and inner surfaces 103 and 104, respectively, while the second member 112 has outer and inner surfaces 113 and 114, respectively. In one embodiment, the first member 102 may comprise a first film and a first motif may be printed upon the outer surface 103 of the first film in accordance with the techniques described herein. Similarly, the second member 112 may comprise a second film and a second motif may be printed upon the outer surface 113 of the second film.

The first and second bands 125 and 126 may be coupled between the first and second members 102 and 112 at spaced apart locations, as shown in FIGS. 5-6. In an exemplary use, the coupling member 100 may be secured to the hearing aid casing 50 by advancing the second band 126 over the first end 54 and towards the second end 55 of the casing 50. The second band 126 may have elastic properties that allow the band to be stretched to an inner diameter larger than an outer diameter of the hearing aid casing 50, thereby facilitating positioning of the second band 126. When an external stretching force is removed, the elastic properties may allow the second band 126 to return to a reduced diameter that causes the second band 126 to fit snugly about the hearing aid casing 50. Similarly, the first band 125 may be positioned over the hearing aid casing 50. In this manner, the second band 126 may be positioned near the second end 55, while the first band 125 may be positioned near the first end 54 of the hearing aid casing 50, as shown in FIG. 6.

At this time, the inner surface 104 of the first member 102 may be disposed at least partially over the front surface 52 of the hearing aid casing 50, preferably in a substantially flush manner. Similarly, the inner surface 114 of the second member 112 may be disposed at least partially over the rear surface 53 of the hearing aid casing 50, preferably in a substantially flush manner, as depicted in FIG. 6. The elastic nature of the first and second bands 125 and 126 may secure the first and second members 102 and 103.

In an alternative embodiment, the first and second members 102 and 112 may comprise a different material, such as a foam or plastic, in lieu of the film itself. In this embodiment, one or more of the outer surfaces 103 and 113 may be imprinted with a preselected motif 82, such that a film is not employed, but rather the motif 82 is printed directly on one or more of the surfaces of the first and second members 102 and 112. Alternatively, the first and second members 102 and 112 may comprise a solid color, such as red, blue, or a selected flesh tone, which itself is the motif if further customization is not intended by the user.

In yet a further alternative, the first and second members 102 and 112 may comprise a material having an outer surface adapted to removably engage a film without the need to use an adhesive, such that a film material is designed to stick to the outer surfaces 103 and 113 for easy placement and removal of the film material. In this manner, various films may be quickly and easily interchanged with one particular coupling member 100 that is disposed over the hearing aid casing 50.

Figure 7:
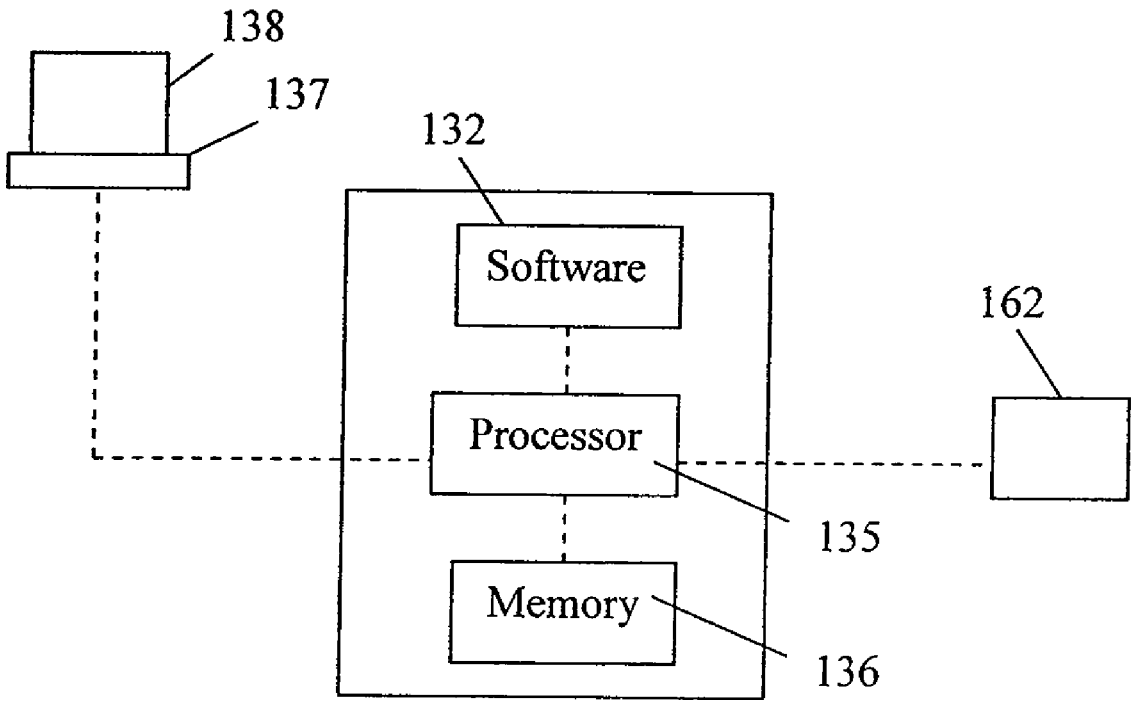
FIG. 7 is a block diagram of one embodiment of a system architecture for customizing a hearing aid casing.

FIG. 7 shows a block diagram of one embodiment of a system architecture for customizing a hearing aid casing, such as the hearing aid casing 50 above. A software program 132 may comprise instructions that are loaded into a memory 136 of a user's computer, such that the software program 132 may be run via a processor 135. For example, the user receives the software program 132 on a removable media or by download. Alternatively, the software program 132 may operate on a server and output information to a separate client processor, such as the user's computer. For example, the user accesses the functions of the software program 132 by communicating via the Internet with a server. In other embodiments, a portion of the software program 132 resides on the user's computer and another portion resides on a remote computer, such as a networked server. For example, the selection of motif information resides on a user computer, but sizing and/or other motif information is downloaded or accessed from a server with up to date information.

The software program 132 may be capable of performing various functions. For example, the software program 132 may comprise software instructions, which may be installed in the memory 136, for helping a user design a customized hearing aid casing 50. Further, the software program 132 may comprise pre-loaded motif designs, including but not limited to colors, patterns, clip art, college logos, sport team logos, skin tones, and the like. The software program 132 also may include or access information, such as precise hearing aid casing dimensions for several hearing aid models. The software program 132 also may be configured to facilitate retrieval, processing, or indexing of data stored on a server coupled to a user's computer.

The processor 135 is a general processor, digital signal processor, application specific integrated circuit, field programmable gate array, analog circuit, digital circuit, combinations thereof or other now known or later developed processor. The processor 135 may be a single device or a combination of devices, such as associated with a network or distributed processing. Any of various processing strategies may be used, such as multi-processing, multi-tasking, parallel processing or the like. The processor 135 is responsive to instructions stored as part of software, hardware, integrated circuits, film-ware, micro-code or the like.

The memory 136 is a computer readable storage media. Computer readable storage media include various types of volatile and non-volatile storage media, including but not limited to random access memory, read-only memory, programmable read-only memory, electrically programmable read-only memory, electrically erasable read-only memory, flash memory, magnetic tape or disk, optical media and the like. The memory 136 may be a single device or a combination of devices. The memory 136 may be adjacent to, part of, networked with and/or remote from the processor 135.

The processor 135 operates pursuant to instructions of the software program 132 stored in the memory 136 or another memory. The processor 135 is programmed for user selection of hearing aid customization. The instructions for implementing the processes, methods and/or techniques discussed herein are provided on the computer-readable storage media or memories, such as a cache, buffer, RAM, removable media, hard drive or other computer readable storage media. The functions, acts or tasks illustrated in the figures or described herein are executed in response to one or more sets of instructions stored in or on computer readable storage media. The functions, acts or tasks are independent of the particular type of instructions set, storage media, processor or processing strategy. In one embodiment, the instructions are stored on a removable media device for reading by local or remote systems. In other embodiments, the instructions are stored in a remote location for transfer through a computer network or over telephone lines. In yet other embodiments, the instructions are stored within a given computer, CPU, GPU or system.

The user's computer may comprise a user input 137 and a display 138. The user input 137 is a mouse, keyboard, switch, buttons, key, slider, knob, touch pad, touch screen, trackball, combinations thereof or other now known or later developed user input device. The user input 137 receives input from a user. In response to activation of the user input 137, signals or data are provided to the processor 135.

The display 138 is a CRT, monitor, flat panel, LCD, projector, or other now known or later developed display device for outputting determined information. For example, the processor 135 causes the display 138 at a local or remote location to output data including a hearing aid model, and creates an interface through which the user may customize the hearing aid casing 50.

The software program 132 may prompt the user to input information, such as the make and model of his or her particular hearing aid, via the user input 137. The display 138 may show information about one or more hearing aid types, including providing an image, model number, or size dimensions on the display 138. After a user selects his or her model, the user input may be stored in the memory 136.

The instructions from the software program 132 may provide another prompt to the user on the display 138 that invites the user to select a desired motif for the hearing aid casing 50. A series of menus with various options may be provided to the user to gather information on a desired motif. For example, the software program 132 may execute instructions displaying a first menu having a general inquiry, such as whether the user would like to implement his or her personal motif, or a motif provided by the software program 132. If the user prefers the first option, a second menu may be displayed inviting the user to upload his or her desired motif. The user may select his or her motif from a local computer, a networked server, or external media, such as a CD or flash drive. In one example, the user may select a digital image, such as an original image from his or her digital camera, which may be uploaded to the memory 136. A customized digital logo or design also may be selected and uploaded to the memory 136.

Alternatively, the user may select a motif that is pre-loaded into the software program 132, or accessible by the software program 132 from a server. The motifs that are pre-loaded into the software program 132 may include one or more images stored in any format, including bitmap, gif or jpeg format. In addition to images, clip-art, logos, patterns and solid colors, still other motifs may be provided or accessible by the software program 132. The memory 136 may store the motifs and produce them on the display 138 in response to user instructions.

Upon selecting the desired motif in response to instructions provided by the software program 132, the motif may be tailored to the selected hearing aid automatically and/or manually via the software program 132. For example, the software program 132 may automatically resize the motif to fit a desired region of the hearing aid casing 50. In the example of FIG. 3, after a user has selected the race car image as his or her motif 82, the software program 132 may automatically resize the race car image to substantially fit the dimensions of the front surface 52 of the particular hearing aid casing 50.

Still further options may be provided to the user by the software program 132. By way of example, the user or processor may select the particular surface of the hearing aid casing 50 for which the motif 82 may be placed. The user may wish to place the motif 82 on the front surface 52, as shown in FIG. 3, or alternatively on the first end 54, in which case the dimensions of the motif 82 may be reduced accordingly.

In accordance with one aspect, the software program 132 is operative to access dimensions associated with multiple hearing aid models. For example, with the hearing aid model shown in FIGS. 3-4, the software program 132 is operative to access precise dimensions for each of the front surface 52, the rear surface 53, the first end 54, the second end 55, the lower surface 56 and the upper surface 57. A table or size information may be included as part of the software program 132 for access or a remote server is accessed. After the user selects a desired motif and desired surface of the hearing aid casing 50, the software program 132 is operative to automatically resize the motif to approximate or be slightly smaller than the dimensions of the selected surface of the hearing aid casing 50. Warping, stretching, expansion, and/or reduction may be used along one or more dimensions for resizing.

While the software program 132 may automatically resize the motif 82, a user may further resize the motif 82 to expand or reduce the dimensions of the motif. Further, software instructions may be provided to the user for positioning the motif 82, for example, placing the motif closer to the second end 55 of the hearing aid casing 50, compared to the first end 54. A user also may select whether he or she wishes to employ a landscape or portrait design, as shown in FIGS. 3 and 4, respectively, in which case the software program 132 may automatically resize the motif 82 as needed. Finally, the computer software 132 also may comprise editing features, such as allowing the user to adjust the brightness or contrast of a selected motif.

After the desired motif has been selected, sized, positioned and edited as desired, the user may print the motif 82. For example, a printer 162 may be locally or remotely coupled to the processor 135. A home printer may be used. Alternatively, a provider or commercial entity has delivered the printed decals or selected motif on the film 80. The film 80 may be loaded into the printer 162. The selected motif 82, with desired dimensions, then may be printed directly on the film 80.

The film 80 with the printed motif 82 may then be coupled to the hearing aid 80 using any of the techniques described above, including but not limited to using an adhesive, fastener, or the coupling member 100 of FIGS. 5-6. The film 80 may become tailed to the dimensions of the casing 50 manually, e.g., the user may cut the film to the approximate dimensions of the casing 50, or in an automated manner, e.g., the motif 82 may be printed on a film 80 having the predetermined appropriate dimensions.

Figure 8:
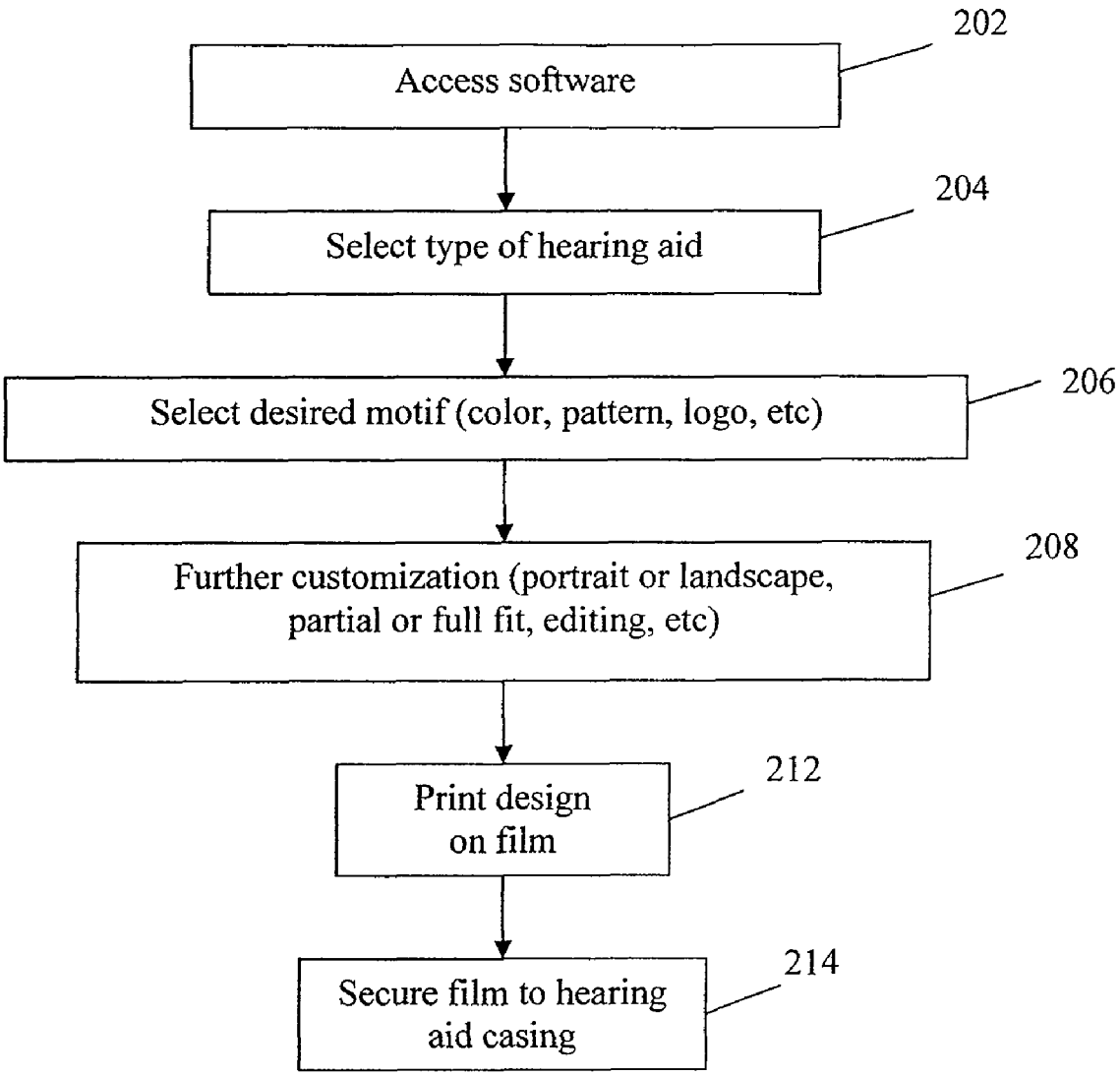
FIG. 8 is a flow chart diagram showing one exemplary method for customizing a hearing aid casing.

FIG. 8 shows exemplary method steps for customizing the hearing aid casing 50. Additional, different or fewer acts than shown in FIG. 8 may be provided. Moreover, the acts may be performed in the order shown or a different order. The acts may be performed automatically, manually, or combinations thereof.

In a first step, in act 202, a user wishing to customize his or her hearing aid casing 50 may access computer software. The software program 132 may be accessed by a computer locally using a CD, flash drive or other medium, or alternatively may be accessed remotely, for example, via a server.

In a next step, in act 204, the software program 132 may prompt a user to select the type of hearing aid, which may include the specific manufacturer and model. The software program 132 may provide the user with listings and/or images of several common models to facilitate the process. The software program 132 then may store information about the selected model, including dimensions associated with each of the surfaces of the casing 50, in the memory 136. The hearing aid may be selected for other purposes, such as purchase, and then the software program 132 is activated for designing the decal.

In act 206, a user may select a desired motif for the hearing aid casing 50. As generally noted above, a wide variety of motifs may be selected. Moreover, an array of motifs may be pre-loaded or otherwise accessible by the software program 132, or alternatively, a user may furnish his or her own motif, such as a personal digital image.

The computer software 132 may automatically resize or otherwise modify the selected motif to generally be compatible with the previously selected hearing aid model. For example, as a default measure, the selected race care motif 82 may be resized to be approximately the size, or slightly smaller than, the front surface 52 of the hearing aid casing 50 when displayed in a landscape format.

In a next step, at act 208, the user may further customize the motif 82. For example, as noted above, a user may select whether the motif 82 will be displayed in a landscape or portrait format, as shown in FIGS. 3-4, respectively. A user also may select which surfaces of the hearing aid casing 50 will display the motif 82, and further may adjust the sizing of the motif and/or its positioning relative to a selected surface of the hearing aid casing 50. Finally, as noted above, a user may edit the motif using the provided software.

After the desired motif has been selected, sized, positioned and/or edited as desired, in act 212 the motif 82 is printed on the film 80 by the user or another. In act 214, the film 80 then may be coupled to the hearing aid 50 using any of the techniques described above, including but not limited to using an adhesive, fastener, or the coupling member 100 of FIGS. 5-6. The user, manufacturer, or another couple the printed film 80 to the hearing aid casing.

By using the apparatus and methods described herein, a user may easily customize his or her hearing aid casing 50. An entity provides software, film 80, and/or customized hearing aids for use by a user. The user is not restricted to displaying the hearing aid casing color and style provided by the manufacturer without customization. Further, since the film 80 may be applied directly to the hearing aid casing 50, or with the use of a coupling member 100, the user does not need to change the casing itself or remove the casing fasteners 65 to customize the hearing aid. Therefore, the design of the casing 50 may be quickly and easily changed in a personalized manner.

While the invention has been described above by reference to various embodiments, it should be understood that many changes and modifications can be made without departing from the scope of the invention. It is therefore intended that the foregoing detailed description be regarded as illustrative rather than limiting, and that it be understood that it is the following claims, including all equivalents, that are intended to define the spirit and scope of this invention.

We claim:

1. A method for customizing a hearing aid casing, the method comprising:

providing a user access to a software program;

receiving a first input from the user, the first input corresponding to a type of hearing aid selected from a plurality of different hearing aid types by the user with the software program, the selected type of hearing aid comprising a first casing, the first casing having a different shape, size, or shape and size than a second casing, another type of hearing aid of the plurality of different hearing aides comprising the second casing;

receiving a second input from the user, the second input corresponding to a motif to be displayed on a portion of at least one surface of the first casing, the second input being selected by the user with the software program;

automatically sizing, using a processor, the selected motif based on the selected type of hearing aid; and providing instructions to print the selected motif on a film to be displayed on the at least one surface of the first casing.

2. The method of claim 1, further comprising:

receiving a third input from the user, the third input corresponding to the at least one surface of the first casing, the at least one surface of the first casing being selected by the user with the software program; and automatically sizing the selected motif based on dimensions of the at least one selected surface of the first casing.

3. The method of claim 1, further comprising:

receiving a third input from the user, the third input corresponding to whether the selected motif is to be displayed on a surface of the at least one surface of the first casing in a landscape or portrait format, whether the selected motif is to be displayed on the surface of the first casing in the landscape or portrait format being selected by the user with the software program; and automatically resizing the selected motif to be displayed accordingly.

4. The method of claim 1, further comprising receiving a third input from the user after the motif is automatically sized, the third input corresponding to a resizing of the motif selected by the user.

5. The method of claim 1, wherein the second input comprises a personal motif that is uploaded for use by the user with the software program.

6. The method of claim 1, wherein the second input is a motif that is pre-loaded into the software program.

7. A method for customizing a hearing aid casing, the method comprising:

providing a user access to a software program;

receiving a first input, the first input corresponding to a type of hearing aid selected from a plurality of different hearing aid types by the user with the software program, the selected type of hearing aid comprising a first casing, the first casing having a different shape, size, or shape and size than a second casing, another type of hearing aid of the plurality of different hearing aid types comprising the second casing, the selected type of hearing aid having an input device disposed at least partially externally;

receiving a second input from the user, the second input corresponding to a motif to be displayed on a portion of at least one surface of the first casing, the second input being selected by the user with the software program;

automatically sizing, using a processor, the selected motif based on the selected type of hearing aid; and providing instructions to print the selected motif on a film to be displayed on the at least one surface of the first casing.

8. A method for customizing a hearing aid casing, the method comprising:

providing, with a software program, a plurality of hearing aid options, casings of at least two hearing aid options of the plurality of hearing aid options each having a different size, shape, or size and shape;

providing, with the software, a plurality of motif options;

receiving, with the software program, user selection of a hearing aid option of the plurality of hearing aid options, the user selected hearing aid option comprising a casing;

receiving, with the software program, user selection of a motif option of the plurality of motif options to be displayed on at least a portion of at least one surface of the casing;

automatically sizing, using a processor, the user selected motif option based on the user selected hearing aid option; and providing instructions to print the user selected motif option on a film to be displayed on the at least one surface of the casing.

* * * * *